United States Patent [19]

Pai

[11] 4,331,438

[45] May 25, 1982

[54] PROCESS FOR ELIMINATING FREE FORMALDEHYDE IN TEXTILE MATERIALS TREATED WITH DIMETHYLOLATED CARBAMATES

[75] Inventor: Panemangalore S. Pai, Charlotte, N.C.

[73] Assignee: BASF Wyandotte Corporation, Wyandotte, Mich.

[21] Appl. No.: 205,490

[22] Filed: Nov. 10, 1980

[51] Int. Cl.[3] ..... D06M 13/40

[52] U.S. Cl. ..... 8/187

[58] Field of Search ..... 8/187

[56] References Cited

U.S. PATENT DOCUMENTS

| | | | |
|---|---|---|---|
| 3,556,713 | 1/1971 | Kullman et al. | 8/182 |
| 3,590,100 | 6/1971 | Weiland | 260/29.4 |
| 3,597,380 | 8/1971 | Bertini et al. | 260/29.4 |
| 3,723,058 | 3/1973 | Reinhardt et al. | 8/182 |
| 3,871,822 | 3/1975 | Goodman et al. | 8/187 |
| 3,957,431 | 5/1976 | Pai et al. | 8/187 |
| 4,207,073 | 6/1980 | Petersen et al. | 8/187 |

FOREIGN PATENT DOCUMENTS

| | | | |
|---|---|---|---|
| 1123677 | 8/1968 | United Kingdom | 8/187 |

*Primary Examiner*—Maria Parrish Tungol

*Attorney, Agent, or Firm*—Andrew E. Pierce

[57] ABSTRACT

A process for elimination of free formaldehyde in textile materials treated with methylolated carbamates is disclosed. Textile materials comprising natural or regenerated cellulose are impregnated in the usual way with a dimethylolated carbamate. After impregnation, drying and curing, at least one side of the treated textile material is treated with a combination of a volatile inert carrier and a formaldehyde acceptor such as urea, ethylene urea, or propylene urea.

11 Claims, No Drawings

PROCESS FOR ELIMINATING FREE FORMALDEHYDE IN TEXTILE MATERIALS TREATED WITH DIMETHYLOLATED CARBAMATES

BACKGROUND OF THE INVENTION

1. Field of the Invention

This invention relates to the treatment of natural or regenerated cellulose textile materials with dimethylolated carbamates to increase the shrink resistance and wrinkle resistance of said materials.

2. Description of the Prior Art

In the manufacture of textile materials comprising natural and regenerated cellulose, it is common to subject such materials to a finishing step utilizing aminoplast substances in order to provide improved wrinkle resistance and shrink resistance to said textile materials. The treatment of said textile materials with aminoplast-substances involves the impregnation with an aqueous solution or dispersion of an aminoplast substance followed by passing the textile material through squeeze rolls and the subsequent drying and curing at elevated temperatures so as to render the treatment wash-fast. At each stage of processing, the presence of free formaldehyde by which is meant formaldehyde which is present but not bound chemically and is therefore free to volatilize from the textile material, has created a serious problem. The presence of free formaldehyde causes discomfort and sometimes an actual health hazard to those who cut, sew, trim, and press the garment made from the aminoplast-treated textile material.

Of the various aminoplast substances utilized to treat textile material comprising natural or regenerated cellulose, the dimethylolated carbamates are particularly objectionable from the standpoint of providing high amounts of free formaldehyde in textile materials treated therewith. This is perhaps because excess formaldehyde must be used in the preparation in order to obtain the dimethylol derivative. For instance, one mole of methylcarbamate is reacted with 2.25 moles of formaldehyde to produce 0.8 mole of the dimethylolmethylcarbamate. It is apparent that an excess of formaldehyde remains in the reaction product.

In the prior art, various means have been proposed for reducing the free formaldehyde content of dimethylolated carbamate finishing agents for textile materials. For instance, the use of lower molar ratios of formaldehyde to carbamate in synthesis has been suggested. This improvement is achieved at the expense of a lower level of chlorine resistance in the finished fabrics. Another approach to decreased free formaldehyde has been the treatment of the solution of the methylolated finishing agent with a reactant that combines with free formaldehyde and thus binds it, preventing its release during fabric processing. Representative examples of such treatments can be found in U.S. Pat. Nos. 3,749,751; 3,590,100; 3,556,713; 3,597,380; and 3,723,058. These various treatments have not been sufficient to reduce the free formaldehyde to sufficiently low levels which is necessary because release of formaldehyde into the environment is objectionable even at low formaldehyde levels.

In U.S. Pat. No. 3,957,431, there is disclosed a method for diminishing the release of free formaldehyde from textile materials treated with aminoplast-forming substances. In the process, a formaldehyde acceptor is applied to the textile material previously impregnated with an aminoplast-forming substance and dried. Typical formaldehyde acceptors are disclosed as urea, ethylene urea, and propylene urea. A review of this reference indicates that the lowest level of free formaldehyde obtained was 77 parts per million as determined by the AATCC method. It is therefore seen that an improved process for eliminating free formaldehyde in textile materials treated with aminoplast-forming substances is necessary.

SUMMARY OF THE INVENTION

There is disclosed a process for eliminating free formaldehyde from textile materials comprising natural or regenerated cellulose treated with a dimethylolated carbamate in order to improve the wrinkle recovery and shrink resistance of said textile material. Unexpectedly, it has been found that, where particular methylolated carbamates are used, the free formaldehyde of such treated textile materials can be eliminated by the treatment of the textile material with a mixture of a formaldehyde acceptor and a volatile inert carrier.

DESCRIPTION OF THE INVENTION AND THE PREFERRED EMBODIMENTS

It has been found possible to eliminate free formaldehyde from textile materials treated with dimethylolated carbamates. Such treatment can improve wrinkle resistance, crease resistance and shrink resistance properties of said textile material wherein said textile material comprises a natural or regenerated cellulose textile fabric. Useful fabrics are cotton fabric, linen fabric, rayon and fabrics consisting of blends of cotton, linen or rayon, and fabrics consisting of blends of cellulosic fibers with non-cellulosic fibers such as polyester/cotton blends and nylon/cotton blends. The term textile material as used herein is intended to include fabrics, whether woven or knitted, and garments or other articles made from such fabrics.

The dimethylolated carbamates useful herein are the dimethylolated aliphatic carbamates produced by the reaction with an excess of formaldehyde of an aliphatic monocarbamate. While the exact structure of this reaction product has not been established, it is believed that a mixture of monomethylol and dimethylol derivatives is produced. The conditions under which the methylolation is carried out are not narrowly critical; the optimum conditions being determined primarily by the particular carbamate utilized. The reaction can take place at temperatures of from about 20° C. to the reflux temperature of the reaction mixture wih reaction times from several minutes to as much as 24 hours, and preferably from about 1 to about 5 hours. The formaldehyde is suitably reacted with the aliphatic monocarbamate in a ratio from about 1.5 to about 3 moles of formaldehyde per mole of carbamate, the optimum amount depending upon the particular carbamate employed. The initial pH of the reaction mixture can be in the range of about 4 to about 11 and is preferably from about 9 to about 11. The useful dimethylolated aliphatic monocarbamates are the methylolated alkylcarbamates, the methylolated hydroxyalkylcarbamates and the alkoxyalkylcarbamates. These materials are generally utilized as aqueous solutions in treating textile materials. These solutions can contain from about 1 to about 3 weight percent of free formaldehyde resulting from the use of excess formaldehyde in the methylolation reaction.

The useful dimethylolated alkyl carbamates have the general formula:

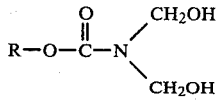

(I)

wherein R is a straight or branched chain alkyl group of 1 to 4 carbon atoms. Representative dimethylolated alkylcarbamates are dimethylolated methylcarbamate, dimethylolated ethylcarbamate, dimethylolated n-propylcarbamate, dimethylolated isobutylcarbamate, and the like.

The dimethylolated hydroxyalkyl carbamates have the general formula:

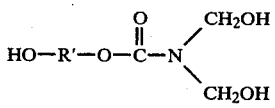

(II)

wherein R' is an alkylene radical having 2 to 4 carbon atoms. Representative dimethylolated hydroxyalkylcarbamates are dimethylolated hydroxyethylcarbamate, dimethylolated hydroxypropylcarbamate, dimethylolated hydroxybutylcarbamate, and the like.

The dimethylolated alkoxyalkyl carbamates have the general formula:

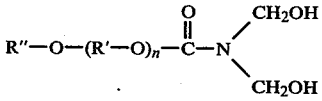

(III)

wherein R'' is a straight or branched chain alkyl group having 1 to 8 carbon atoms, R' is an alkylene radical having 2 to 4 carbon atoms, and n is an integer having a value of from 1 to 100. Representative examples of the dimethylolated alkoxyalkylcarbamates are dimethylolated methoxyethylcarbamate, dimethylolated ethoxyethylcarbamate, dimethylolated n-butoxyethylcarbamate, dimethylolated methoxyethoxyethylcarbamate, dimethylolated methoxyethoxyethylcarbamate, dimethylolated methoxyisopropylcarbamate, dimethylolated methoxypropoxypropylcarbamate, dimethylolated methoxyethoxyethylcarbamate, dimethylolated iso-butoxyethoxyethylcarbamate, and the like.

As will be understood by those skilled in the art, mixed carbamates can be utilized as finishing agents for textile materials and that the dimethylolated carbamates can contain small amounts of monomethylolated species as the result of incomplete reaction during the production of such methylolated carbamates. Generally, these dimethylolated aliphatic carbamates are utilized in aqueous solutions containing from about 1 to about 3 weight percent of free formaldehyde resulting from the use of excess formaldehyde added in the methylolation reaction. The treated textiles contain about 5 to about 15 percent by weight, preferably about 5 to about 10 percent by weight, of said aliphatic carbamate, based upon the weight of the untreated textile material.

In order to eliminate free formaldehyde in textile materials treated with the dimethylolated carbamates disclosed herein, it is necessary to treat the dimethylolcarbamate impregnated textile materials after drying and curing with an effective amount of a combination of a volatile inert carrier and a formaldehyde acceptor containing about 2 to about 60 percent by weight of said formaldehyde acceptor. The amount of formaldehyde acceptor applied to the fabric depends upon the activity of the particular formaldehyde acceptor and the amount of dimethylolated carbamate applied to the textile material. Generally, an amount of about 1 percent to about 5 percent, preferably about 2 to about 4 percent by weight is applied to the dimethylolcarbamate impregnated cured textile material, based upon the dry weight of said textile material.

The useful formaldehyde acceptors are compounds which have a molecular weight of less than 200 and contain the group

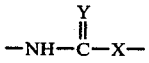

(IV)

wherein X is O, NH, or $CH_2$ and Y is O, NH, or S, as disclosed in U.S. Pat. No. 3,957,431, incorporated herein by reference. Urea is the most economical formaldehyde acceptor containing the above group and is, at the same time, sufficiently active and accordingly it is the preferred formaldehyde acceptor. Other formaldehyde acceptors containing the above group in a 5- or 6-membered ring are exemplified by ethylene urea and propylene urea. Representative formaldehyde acceptors which contain the above group are 4-methylethylene urea, 4,5-dimethylethylene urea, 4,5-dihydroxyethylene urea, 1,3-oxazolidin-2-one, pyrrolidone-2-monomethylurea, monomethylurea, dimethylurea, thiourea, a guanidine salt of a mineral acid, and dicyandiamide. Specifically, the carbonate or sulfate salt of guanidine is useful as a formaldehyde acceptor.

The formaldehyde acceptor is applied in admixture with an inert liquid to the cured textile material either by spraying or slop padding, preferably by exposing the cured textile material to a fog or mist of the liquid in admixture with the formaldehyde acceptor in an enclosed area or "fog chamber". Generally, the formaldehyde acceptor is applied from a solution or dispersion in a volatile inert carrier which is a liquid at ambient temperature and pressure. Preferably, a solution is used comprising water and formaldehyde acceptor. Other volatile inert carriers can be used such as a lower alkyl alcohol having 1–4 carbon atoms, for instance methyl, ethyl, and isopropyl alcohol. Generally, both sides of the textile material are sprayed, padded or fogged when this method is chosen as a means of applying the formaldehyde acceptor, but good results can be obtained by treating only one side of the textile material.

Preferably, the formaldehyde acceptor is applied to both sides of the textile material by passing the impregnated, dried, and cured dimethylol carbamated-treated textile material through a spray chamber (designated a "fog chamber") in which the mixture of formaldehyde acceptor and volatile inert carrier, preferably water, is atomized to produce a fog or mist which is applied onto both sides of said treated textile material. The textile material is treated with a mixture comprising a formaldehyde acceptor subsequent to oven curing generally at a temperature of about 130° C. to about 180° C. Generally, no added drying is required if the textile material is treated with formaldehyde acceptor as it emerges from a curing oven.

It is conventional to include an acid or potentially acid catalyst in the impregnation bath with the dimethylolcarbamates disclosed herein in order to promote the rate of cure of the carbamate after impregnation on the textile material. These are generally inorganic or organic acids such as sulfuric acid, hydrochloric acid, phosphoric acid, boric acid, formic acid, acetic acid, oxalic acid, tartaric acid, maleic acid, and salts which have an acid reaction or which form acids upon the action of heat and/or by hydrolysis. Useful acid-forming salts are ammonium salts and amine salts of strong acids, magnesium chloride, zinc chloride, and zinc nitrate. Mixtures of more than one catalyst can also be used. To minimize free formaldehyde in the treated textile, it is preferred to use such catalysts as magnesium chloride, zinc nitrate, and zinc chloride as catalysts. It is desirable to add the catalyst to the impregnating liquor containing the dimethylolated carbamate. The concentration of catalyst chosen is within the usual range for the particular finishing method used. Catalyst concentrations are from 1 to 40 grams per liter or with reference to the weight of the dimethylolcarbamate, amounts of catalysts of from about 4 to about 60 percent, preferably from about 20 to 40 percent, are generally used. Where it is desired to effect cure in the presence of considerable amounts of water or at a low reaction temperature, it may be necessary to use strongly acid catalysts at a concentration of up to 20 normal.

The concentration of dimethylolated carbamate resin utilized in the impregnating liquor can be such as to provide about 2 to about 25 percent by weight of active solids of the dimethylolated carbamate based upon the weight of the textile material. Preferably, about 5 to about 15 percent by weight active solids of dimethylolated carbamate are utilized. Generally, the concentration of active solids of the dimethylolated carbamate in the impregnation bath is from about 50 to about 200 grams per liter. As is conventional, the impregnated material can be freed from excess treatment liquor by squeezing the textile material between rolls so as to provide the desired amount of solids of the dimethylolated carbamate on the textile material.

The impregnation bath can also contain conventional textile treating agents such as flame-proofing agents, water and soil repellants, antistatic agents, dyes, leveling agents, pigments, and binders and also conventional textile auxiliary agents such as softeners, catalysts, dying assistants, buffers, wetting agents, and the like. Examples of water repellants are aluminum-containing and zirconium-containing paraffin wax emulsions, silicon-containing water repellants, and perfluorinated aliphatic compounds. Examples of conventional softeners are ethoxylation products of higher fatty acids, fatty alcohols, and fatty acid amides, high molecular weight polyglycol ethers, higher fatty acids, fatty alcohol sulfonates, N-stearyl-N,N'-ethylene urea and stearylamidomethylpyridinium chloride. Examples of leveling agents are water-soluble salts of acid esters of polybasic acids with ethylene oxide or propylene oxide adducts of relatively long-chain alkoxylated alkaline substances. Examples of wetting agents are salts of alkylnaphthylene sulfonic acid, alkali metal salts of sulfonated dioctylsuccinate and the adducts of alkylene oxides and fatty alcohols, alkylphenols, fatty amines, and the like. These textile finishing agents are generally used in amounts of from 0.3 to 4 percent and preferably from 1 to 2.5 percent by weight of the dry weight of the textile material.

The impregnation of the textile material with the dimethylolated carbamate can be carried out in any desired manner, for example, by spraying or by dipping the textile material into an impregnation bath. Conventionally, padding machines are used for this purpose with the textile material being dipped into the treatment bath followed by removal of the excess liquor from the textile material by squeezing or centrifuging. Generally, a wet pickup is attained utilizing padding equipment between 50 and 80 percent by weight based upon the dry weight of the fabric, preferably about 60 to about 70 percent by weight.

The following three test methods, each incorporated herein by reference, were used to evaluate the physical properties of the treated textile material. The test method utilized to determine free formaldehyde was that according to AATCC Specification No. 112-1975. The test method used for determination of durable press was the method according to AATCC Specification No. 124-1975, and the method used for determining percent shrinkage was the method according to AATCC Specification No. 135-1973.

The following examples illustrate the various aspects of the invention but are not intended to limit its scope. Where not otherwise specified throught this specification and claims, temperatures are given in degrees centigrade and parts, percentages, and proportions are by weight.

EXAMPLE 1

(Control forming no part of this invention)

In order to illustrate the results obtained utilizing an aminoplast-forming substance which is particularly preferred in the prior art, control samples of a 50 percent/50 percent by weight polyester/cotton sheeting fabric was impregnated on a padder with a treatment liquor containing 100 parts by weight per 1000 parts by weight of a 40 percent active dimethylol glyoxal monourein having the formula:

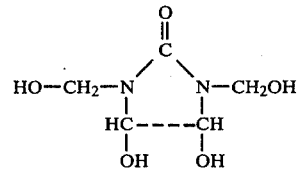

This material is also known by those skilled in the art as dimethyloldihydroxyethyleneurea. It is the preferred aminoplast-forming substance of the prior art where it is desired that the textile material is to be impregnated, dried, and cured before being fashioned into a garment and where it is desired that a minimum amount of formaldehyde be released into the atmosphere while the goods are in storage or during the cutting and sewing operations. The preferred catalyst for use with this aminoplast-forming resin is zinc nitrate. It is used in the proportion of 12 parts by weight of a 25 percent by weight solution of anhydrous zinc nitrate. To complete the impregnating liquor, one part by weight of a nonionic wetting agent sold under the trademark TRITON X-100 per 1000 parts by weight of liquor was utilized. The textile material is impregnated with the above-described impregnating liquor, a liquor wet pickup of 60 percent by weight based upon the dry weight of the fabric was obtained. The impregnated fabric was next dried for 60 seconds at 225° F. and then subjected to condensation (curing) for 90 seconds at 350° F. Evaluation of the treated textile material for free formaldehyde by the AATCC Test Method 112-1975 provided a mean value of 1095 parts per million.

EXAMPLE 2

(Control, forming no part of this invention)

As a means of determining the effect of incorporating a formaldehyde acceptor in the impregnating liquor utilized to treat the textile material, 30 grams of urea were added to 1000 grams of an impregnating liquor containing 100 grams per liter of a 40 percent by weight active solution of the dimethylol glyoxal monourein product of Example 1 in combination with one gram of a nonionic wetting agent sold under the trademark TRITON X-100. The textile material was impregnated with the treatment liquor so as to obtain a wet pickup of 60 percent by weight after which the textile material was dried for 60 seconds at 225° F. and then subjected to condensation (curing) for 90 seconds at 350° F. Determination of free formaldehyde remaining in the textile material by AATCC Test Method 112-1975 indicated a mean value of 900 parts per million.

EXAMPLE 3

(Control, forming no part of this invention)

In order to illustrate the effect of utilizing a dimethylol glyoxal monourein product as a substitute for the pyrimidone product utilized in the process of this invention, 1000 grams of impregnating liquor was made up containing 100 grams per 1000 grams of a 40 percent by weight active solution of the dimethylol glyoxal monourein product of Example 1, one gram per 1000 grams of a nonionic wetting agent sold under the trademark TRITON X-100, and 12 grams of a 25 percent by weight solution of anhydrous zinc nitrate. The textile material of Example 1 was impregnated with the above-described impregnating liquor so as to obtain a 60 percent by weight wet pickup. Then, the textile material was dried for 60 seconds at 225° F. Subsequently, the textile material was subjected to condensation (curing) for 30 seconds at 350° F. Both sides of the impregnated, dried textile material were next sprayed utilizing a 30 percent by weight aqueous solution of urea so as to obtain 10 percent wet pickup based upon the dry weight of the previously treated fabric. Evaluation for free formaldehyde provided a mean value of 426 parts per million based upon the fabric as determined by the AATCC Test Method 112-1975.

EXAMPLE 4

(Control, forming no part of this invention)

The textile material of Example 1 was impregnated in accordance with the procedure of Example 1 utilizing an impregnating liquor containing 100 parts by weight of a 35 percent by weight solution of dimethylolisobutylcarbamate, 30 parts by weight of magnesium chloride hexahydrate, and 1 part by weight of a non-ionic wetting agent sold under the trademark TRITON X-100 per 1000 parts total weight of impregnating liquor. The textile material was impregnated so as to obtain a wet pickup of 60 percent by weight, based upon the weight of the dry fabric. Thereafter, the fabric was dried for 60 seconds at 225° F. and then subjected to condensation (curing) for 90 seconds at 350° F. Free formaldehyde as measured by the AATCC Test Method was 130 parts per million.

EXAMPLE 5

(Control, forming no part of this invention)

Example 4 was repeated except that the aqueous impregnating liquor contained 30 parts by weight of urea. The fabric was impregnated, dried, and cured in the same manner as indicated in Example 4. Free formaldehyde, as determined by the AATCC Test Method 112-1975 was found to be 340 parts per million.

EXAMPLE 6

Example 4 was repeated except that subsequent to drying and curing for 90 seconds at 350° F., the treated textile material was subjected to spray application of a 30 percent by weight aqueous solution of urea applied to both sides of the textile material so as to obtain a wet pickup of 10 percent by weight based upon the weight of the dried fabric. Evaluation for free formaldehyde by AATCC Test Method 112-1975 resulted in a determination of 0 parts per million of free formaldehyde.

EXAMPLES 7 AND 8

(Controls, forming no part of this invention)

Example 3 was repeated utilizing in place of urea as the formaldehyde acceptor, the formaldehyde acceptors ethyleneurea and propyleneurea, respectively. Evaluation for free formaldehyde in the treated textile material in accordance with the AATCC Test Method 112-1975 resulted in a determination of 220 parts per million and 648 parts per million, respectively.

EXAMPLES 9 AND 10

Example 6 was repeated substituting for urea the formaldehyde acceptors ethyleneurea and propyleneurea, respectively. Evaluation for free formaldehyde in the cured fabric resulted in a determination of 0 parts per million in both Examples 9 and 10.

EXAMPLES 11-13

(Controls, forming no part of this invention)

Examples 1, 3 and 4 were repeated except that the impregnating bath contained a non-ionic softener sold under the trademark EMERSOFT 7727 (Emery Industries) in the amount of 30 parts by weight per 1000 parts by weight of impregnating liquor. Durable press rating and percent shrinkage was determined in accordance with AATCC Test Method 124-1975 and AATCC Test Method 135-1973, respectively. The test results are tabulated in the following table.

EXAMPLE 14

Example 6 was repeated except that the impregnating liquor contained 30 parts by weight per 100 parts by weight of impregnating liquor of a non-ionic softener sold under the trademark EMERSORF 7727 (Emery Industries). Durable press and percent shrinkage was determined in accordance with the above AATCC Test Methods. The results are tabulated in the following table.

TABLE

Durable Press and Percent Shrinkage of Treated Textiles

| Example | 11 | 12 | 13 | 14 |
|---|---|---|---|---|
| Durable Press | 3.4 | 3.4 | 3.9 | 3.9 |

TABLE-continued

| Durable Press and Percent Shrinkage of Treated Textiles | | | | |
|---|---|---|---|---|
| Example | 11 | 12 | 13 | 14 |
| (AATCC 124-1975) Percent Shrinkage (warp and fill) (AATCC 135-1973) | 1.2 × 0.95 | 0.9 × 1.5 | 0.5 × 0.5 | 0.3 × 0.1 |

While this invention has been described with reference to certain specific embodiments, it will be recognized by those skilled in the art that many variations are possible without departing from the scope and spirit of the invention. Therefore, it will be understood that it is intended to cover all changes and modifications of the invention disclosed for the purpose of illustration which do not constitute departures from the spirit and scope of the invention.

The embodiments of the invention in which an exclusive privilege or property is claimed are defined as follows:

1. In a process for finishing textile material comprising natural or regenerated cellulose by impregnating said textile material with a solution or dispersion comprising a dimethylolated aliphatic carbamate and an acid or acid-forming catalyst and drying and curing the impregnated textile material, the improvement comprising eliminating free formaldehyde from said impregnated textile material after drying and curing said impregnated textile material by treating said impregnated textile material with an effective amount of a combination consisting of a formaldehyde acceptor and a volatile inert carrier, said combination containing about 2 to about 60 percent by weight of said formaldehyde acceptor in the form of a compound having a molecular weight of less than 200 and containing the group $$-NH-\overset{\overset{\displaystyle O}{\|}}{C}-X-$$

wherein X is O, NH, or $CH_2$ and Y is O, NH, or S wherein said dimethylolated aliphatic carbamate is selected from at least one of the group consisting of dimethylolated alkyl carbamates.

2. The process of claim 1 wherein said dimethylolated alkyl carbamate is selected from carbamates having the general formula

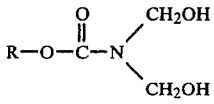

wherein R is a straight or branched chain alkyl group of 1 to 4 carbon atoms.

3. The process of claim 2 wherein said formaldehyde acceptor is selected from the group consisting of urea, ethylene urea, propylene urea and mixtures thereof and said formaldehyde acceptor is dissolved or dispersed in a volatile inert carrier selected from the group consisting of water, a lower alkyl alcohol and mixtures thereof.

4. The process of claim 3 wherein said process comprises impregnating said textile material with said methylolated alkyl carbamate, drying and curing the impregnated textile material, and spraying an aqueous solution of said formaldehyde acceptor onto both sides of said impregnated textile material.

5. The process of claim 4 wherein said carbamate is dimethylolisobutylcarbamate, said formaldehyde acceptor is urea, and said textile material is passed through a chamber containing an atomized fog or mist.

6. The process of claim 2 wherein said formaldehyde acceptor is selected from the group consisting of at least one of 4-methylethylene urea, 4,5-dimethylethylene urea, 4,5-dihydroxyethylene urea, 1,3-oxazolidin-2-one, pyrrolidone-2-monomethylurea, monomethylurea, dimethylurea, thiourea, a guanidine salt of a mineral acid, and dicyandiamide.

7. The product of the process of claim 1 or 2.

8. The product of the process of claim 3.

9. The product of the process of claim 4.

10. The product of the process of claim 5.

11. The product of the process of claim 6.

* * * * *